United States Patent [19]

Toth

[11] 4,252,250

[45] Feb. 24, 1981

[54] MULTIPLE-BEAM OPTICAL SENSING SYSTEM FOR AN ARTICLE VENDOR

[75] Inventor: Bartholomew L. Toth, St. Louis, Mo.

[73] Assignee: UMC Industries, Inc., Stamford, Conn.

[21] Appl. No.: 946,589

[22] Filed: Sep. 28, 1978

[51] Int. Cl.[3] ..... G07F 11/58

[52] U.S. Cl. ..... 221/13; 221/195; 221/255; 250/223 R

[58] Field of Search ..... 221/12, 13, 195, 2, 221/255; 250/206, 221, 222 R, 223 R, 578; 356/244

[56] References Cited

U.S. PATENT DOCUMENTS

| | | | |
|---|---|---|---|
| 3,889,118 | 6/1975 | Walker | 250/221 X |
| 3,967,111 | 6/1976 | Brown | 250/222 R X |
| 3,970,846 | 7/1976 | Schofield, Jr. et al. | 250/221 |
| 4,108,333 | 8/1978 | Falk et al. | 221/13 |

*Primary Examiner*—Robert J. Spar
*Assistant Examiner*—Edward M. Wacyra
*Attorney, Agent, or Firm*—Senniger, Powers, Leavitt and Roedel

[57] ABSTRACT

A multiple-beam optical sensing system for an article vendor having a delivery station to which an article to be vended is delivered during the vend which system includes first and second optoelectronic emitters, first and second optoelectronic detectors, a circuit for energizing the emitters, and a logic circuit. The emitters emit electromagnetic radiation across the delivery station to the detectors, each detector being disposed across the delivery station from its respective emitter. When no article is present at the delivery station, the radiation from the emitters is unobstructed in its passage across the delivery station from the emitters to their respective detectors. When an article is present, however, the radiation is at least partially obstructed. The detectors detect the presence of an article at the delivery station by the obstruction of the radiation from their respective emitters. The energizing circuit enables the emitters alternately so that when one emitter is enabled the other is disabled. The logic circuit determines that an article is present at the delivery station by examining the detectors in turn, a detector being examined only when its corresponding emitter is enabled.

7 Claims, 9 Drawing Figures

MULTIPLE-BEAM OPTICAL SENSING SYSTEM FOR AN ARTICLE VENDOR

BACKGROUND OF THE INVENTION

This invention relates to sensing articles at a delivery station in a vendor and more particularly to a multiple-beam optical sensing system for sensing such articles.

It has been found to be advantageous in present vendors to have some means for sensing if an article is present at the delivery station, i.e., at the place where the customer physically removes the vended article from the vendor. For example, such sensing is desirable to prevent a second article from being vended when a first article is still present at the delivery station.

Present sensor systems, using multiple beams, exemplified by U.S. Pat. No. 4,108,333, perform this sensing function well. But there is some room for improvement. For example, the sensor system of the abovementioned patent has two emitters and two detectors, the emitters being disposed on the left-hand side of the delivery station and the detectors being disposed on the right-hand side of said station. Both emitters are "on", i.e., emitting electromagnetic radiation, at the same time. The power consumption while the emitters are on is, of course, approximately double that of a single emitter. It is necessary to use two emitters to ensure that no article at the delivery station remains undetected. The emitters of the abovementioned patent can be pulsed, which reduces power consumption, but this pulsing generates a considerable amount of noise in the system, which must be filtered out.

Because the emitters of the abovementioned patent are both on the same side of the delivery station, there exists the possibility that cross talk could be a problem. If one of the emitters does not emit a sufficiently focused beam of electromagnetic radiation, that radiation might be detected not only by its detector, but also by the second detector. Of course, if an article at the delivery station were relatively close to the second emitter so as not to fall within the unfocused beam of the first emitter, it would not be detected. The first emitter's beam would be detected by both detectors thereby indicating the absence of an article at the delivery station even though the second emitter's beam would be blocked.

The potential problem of cross talk can be eliminated by having one emitter and one detector on each side of the delivery station. This arrangement also has the desirable result that identical units, i.e., units consisting of one emitter and one detector, can be used on both sides of the delivery station. There are problems with this arrangement too, however. Such a system, for example, behaves like a reflective system if the article present at the delivery station is sufficiently reflective to the electromagnetic radiation of the emitters. In such circumstances, rays from an emitter on one side of the delivery station are likely to be reflected back to the same side and detected by the detector on that side. If this also happens with the emitter-detector pair on the opposite side of the delivery station, no article is detected since the detectors have no way of telling from which side the rays originated.

Another problem arises in present systems when an article only partially interrupts the beam from one emitter and does not interrupt the beam from the other emitter. All systems have thresholds of detection, and if this article is right on the threshold of bring detected, ambient light sources (such as electric light bulbs whose output oscillates at 60Hz) can cause the system to oscillate between detecting and not detecting the article. This "chatter", especially if rapid, is highly undesirable.

SUMMARY OF THE INVENTION

Among the several objects of this invention may be noted the provision of a multiple-beam optical sensing system having more desirable power consumption; the provision of such a system having less noise and requiring less filtering; the provision of such a system that eliminates the problem of cross talk; the provision of such a system having identical emitter-detector units on each side of the delivery station; the provision of such a system which operates satisfactorily irrespective of the reflectivity of the article being sensed; and the provision of such a system that positively detects an article and hence is not subject to the problem of "chatter".

Briefly, the multiple-beam optical sensing system of the present invention comprises first and second optoelectronic emitters for emitting electromagnetic radiation across a delivery station of an article vendor, to which delivery station an article to be vended is delivered during a vend. The system also includes first and second optoelectronic detectors, energizing means, and logic means. Each optoelectronic detector is disposed across the delivery station from its respective emitter for detecting electromagnetic radiation emitted by that emitter. The radiation from the first and second emitters is unobstructed in its passage across the delivery station from said emitters to their respective detectors when no article is present at the delivery station. But when an article is present at the delivery station the radiation is at least partially obstructed. Each detector is responsive to at least partial obstruction of the electromagnetic radiation from its respective emitter to detect the presence of an article at the delivery station. The energizing means energizes the first and second emitters alternately, each emitter being disabled when the other emitter is energized so that when one of the emitters is emitting electromagnetic radiation the other emitter is disabled. The logic means, which is controlled by the energizing means, and is responsive to the detectors, determines whether an article is present at the delivery station, the energizing means controlling the logic means to be responsive to a detector only when its respective emitter is enabled. The logic means determines that an article has been delivered to the delivery station if at least one of the detectors detects an article at the delivery station while its respective emitter is energized.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
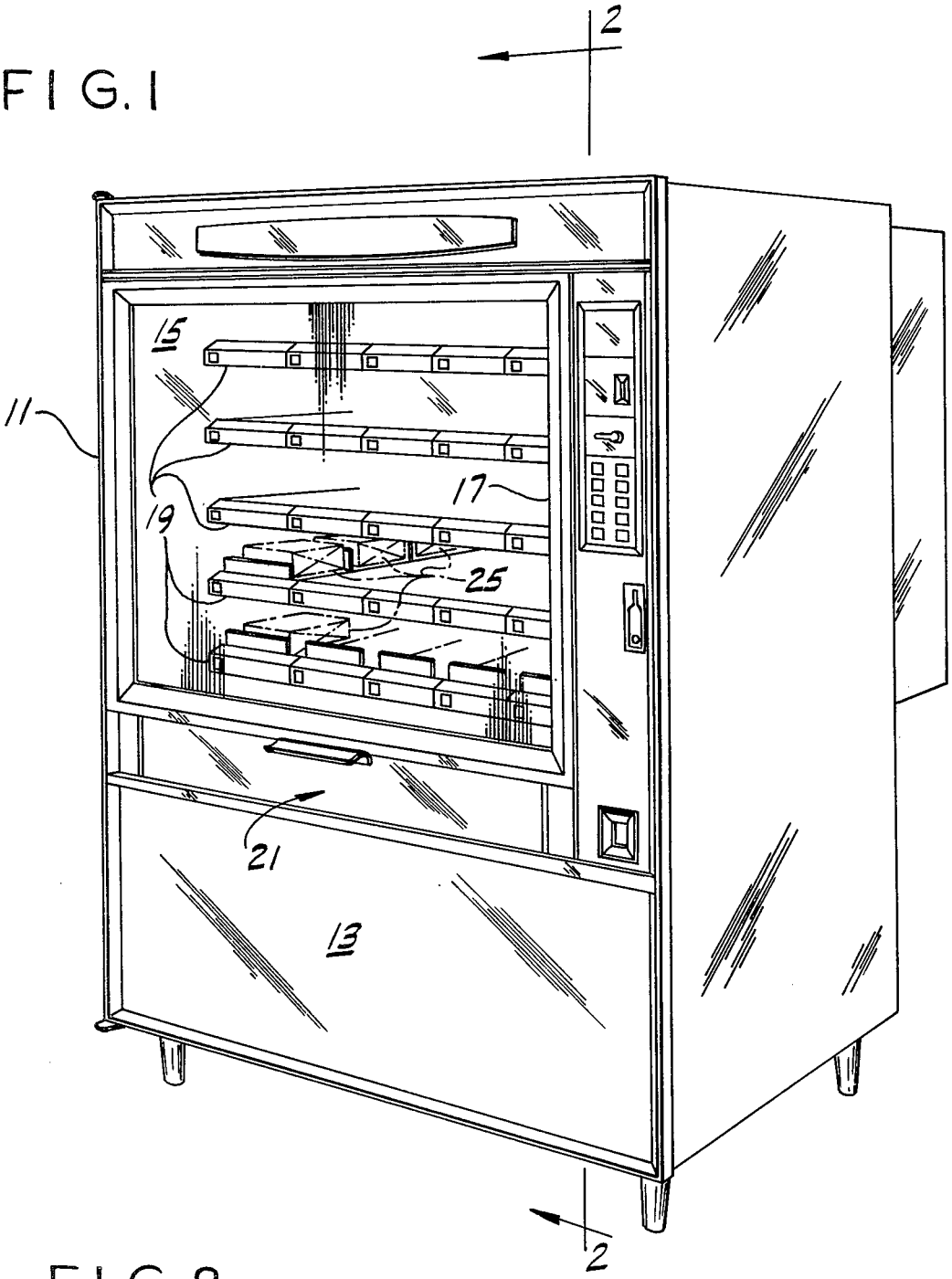
FIG. 1 is a perspective of an article vendor in which the multiple-beam optical sensing system of the present invention is used.
Figure 2:
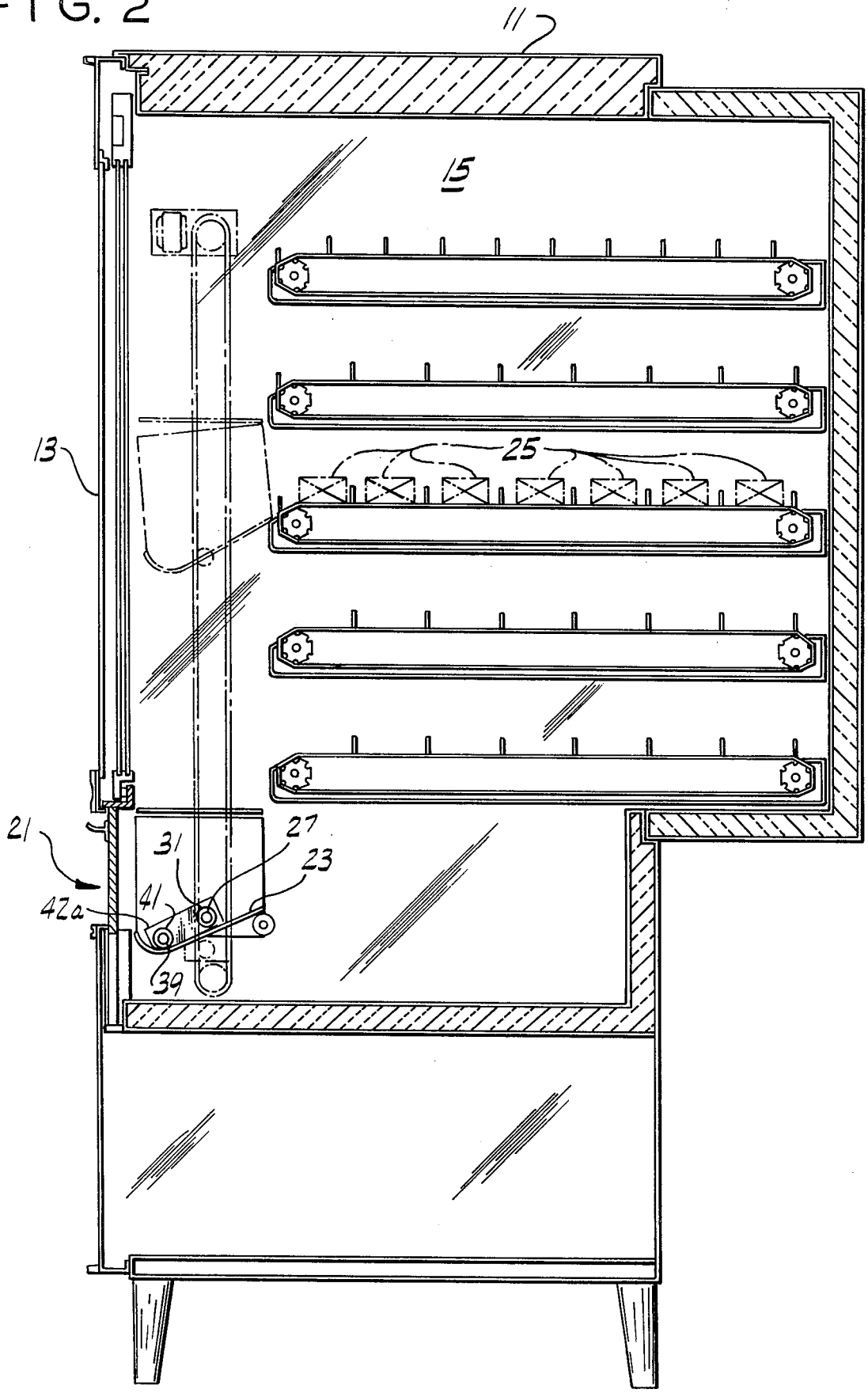
FIG. 2 is a vertical section generally on line 2–2 of FIG. 1 with parts broken away, showing one optoelectronic emitter and one optoelectronic detector of the present invention.

Referring now to the drawings, there is shown in FIG. 1 a vendor 11 having a front 13, a left-inside wall 15, a right-inside wall 17, a plurality of tiers of article dispensers 19 spaced somewhat from front 13, a delivery station 21 disposed to the front of and below tiers 19 and an elevator 23 (see FIG. 2) for conveying any selected article of a plurality of articles 25 from its respective tier to the delivery station. The operation of vendor 11 is described in U.S. Pat. No. 4,108,333. Briefly, upon selection of an article by the customer, that article is conveyed off its respective tier onto the elevator, which is at that time adjacent said tier. The elevator thereupon descends to the delivery station and remains there until the vended article is removed. That is, elevator 23 delivers the selected article to the delivery station during the vend.

Figure 3:
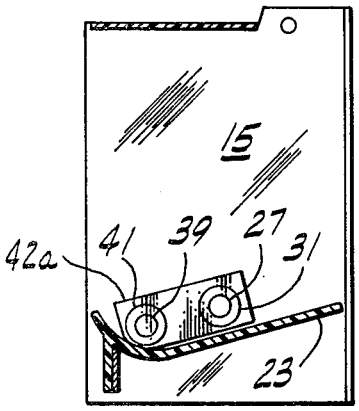
FIG. 3 is a view in elevation of the left end of an elevator of the article vendor of FIG. 1 showing one emitter and one detector of the present invention on an enlarged scale.
Figure 4:
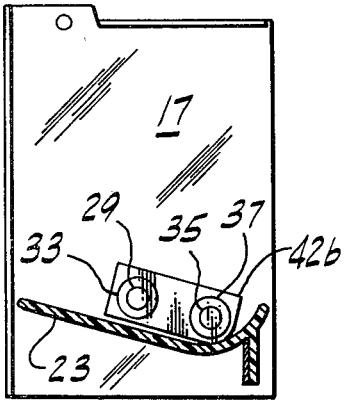
FIG. 4 is a view in elevation of the right end of the elevator of the article vendor of FIG. 1 showing a second emitter and a second detector of the present invention on an enlarged scale.

A first optoelectronic emitter 27 (see FIG. 3) is mounted in the left-inside wall of vendor 11 at a position slightly above the surface of the elevator, spaced somewhat toward the rear of the elevator. A first optoelectronic detector 29 (see FIG. 4) is mounted in the right-inside wall of the vendor at a position corresponding to that of emitter 27. Left-inside wall 15 and right-inside wall 17 have holes 31 and 33 in them at the positions of emitter 27 and detector 29 so that electromagnetic radiation passes freely across the delivery station from emitter 27 to detector 29 in the absence of an article on elevator between said emitter and detector. The radiation takes the form of a beam at least part of which falls upon detector 29 after crossing the delivery station. When an article on the elevator at the delivery station at least partially obstructs this beam, detector 29 senses this fact and thereby detects the presence of the article.

A second optoelectronic emitter 35 is mounted behind a hole 37 in right-inside wall 17 at a position slightly above the surface of the elevator spaced somewhat toward the front of the elevator. A second optoelectronic detector 39 is mounted behind a hole 41 in left-inside wall 15 at a position corresponding to that of emitter 35 so that the beam of electromagnetic radiation from emitter 35 passes freely across the delivery station to detector 39 in the absence of an article on the elevator between them. Emitters 27 and 35 and detectors 28 and 39 are positioned with respect to the other so that any article 25 on the elevator will at least partially obstruct the radiation between at least one emitter and its respective detector. That is, no matter where an article is disposed at the delivery station, it will at least partially obstruct either the beam between emitter 27 and detector 29 or the beam between emitter 35 and detector 39. It will be understood that the phrase "at least partially obstruct" means simply that the obstructed beam is sufficiently obstructed that the corresponding detector detects the presence of the article at the delivery station.

In order to filter out unwanted radiation (namely, visible radiation) and to permit the desired radiation (namely infrared radiation) to pass freely between the emitters and their respective detectors, two infrared-transparent, visible-opaque filters **42*a* (FIG. 3) and 42*b* (FIG. 4) are provided over holes 31, 41 and 33, 37** respectively. This helps insure that the detectors are responsive only to the radiation emitted by the emitters and not to extraneous sources of radiation.

Figure 5:
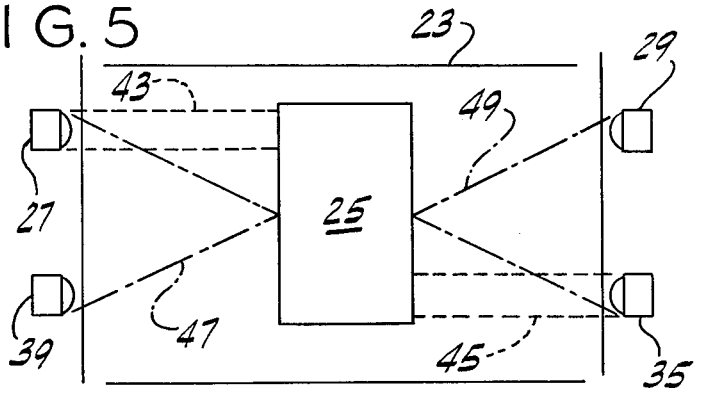
FIG. 5 is a semi-diagrammatic representation of the emitters and detectors of the present invention illustrating one possible problem with multiple-beam sensing systems.

FIG. 5 schematically shows article 25 obstructing both the beam from emitter 27, indicated by the reference numeral 43, and the beam from emitter 35, indicated by the reference numeral 45. Detectors 29 and 39 are responsive to this obstruction of their respective beams to detect the article at the delivery station. On occasion, however, by reason of the reflectivity of the article being detected, misalignment of the emitters and the like, certain rays of beams 43 and 45 are reflected from the article back to the detector on the same side as the emitter from which they were originated. These rays are indicated by the phantom lines 47 and 49 on FIG. 5. Detectors 29 and 39 are incapable of discriminating between radiation from emitter 27 and that from emitter 35, so when rays 47 and 49 are sufficiently strong, the detectors do not detect the article at the delivery station during the time they are receiving rays 47 and 49.

Figure 6:
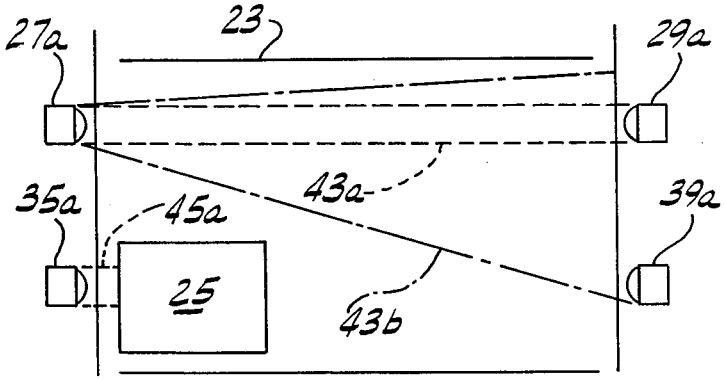
FIG. 6 is a semi-diagrammatic representation of the emitters and detectors of the present invention illustrating another possible problem with multiplebeam sensing systems.

A schematic of an alternative arrangement of the emitters and detectors used in the present invention is shown in FIG. 6. Two emitters **27*a* and 35*a* are disposed on the left side of the delivery station and their respective detectors 29*a* and 39*a* are disposed on the right side of the station. As shown by the dashed lines, a beam 43*a* is unobstructed in its path from emitter 27*a* to emitter 29*a*, but a beam 45*a* from emitter 35*a* is completely obstructed by article 25. Detector 39*a*, therefore, detects the presence of article 25 at the delivery station. If the beam from emitter 27*a* is not sufficiently focused or aligned, however, it can also fall on detector 39*a*. This is shown by phantom beam 43*b*. While beam 43*b* is falling on detector 39*a*, that detector will not detect the presence of article 25** at the delivery station.

To ensure that problems such as shown in FIGS. 5 and 6 do not result in an article at the delivery station remaining undetected, emitters 27 and 35 and detectors 29 and 39 (or alternatively, emitters **27*a* and 35*a* and detectors 29*a* and 39*a*) are included in a system 51 (see FIGS. 7A and 7B) which includes an energizing circuit 53 and a logic circuit 55. Energizing circuit 53 constitutes means for energizing emitters 27 and 35 alternately. Each emitter is disabled by circuit 53 when the other emitter is energized so that when one of the emitters is emitting electromagnetic radiation the other emitter is disabled. Logic circuit 55 constitutes means controlled by circuit 53 and responsive to detectors 29 and 39 for determining whether an article is present at the delivery station. Circuit 53 controls the logic circuit to be responsive to a particular detector only when its respective emitter is energized. If at least one of the detectors detects an article at the delivery station while its respective emitter is energized, logic circuit 55** determines that an article has been deposited at the delivery station.

Figure 7A:
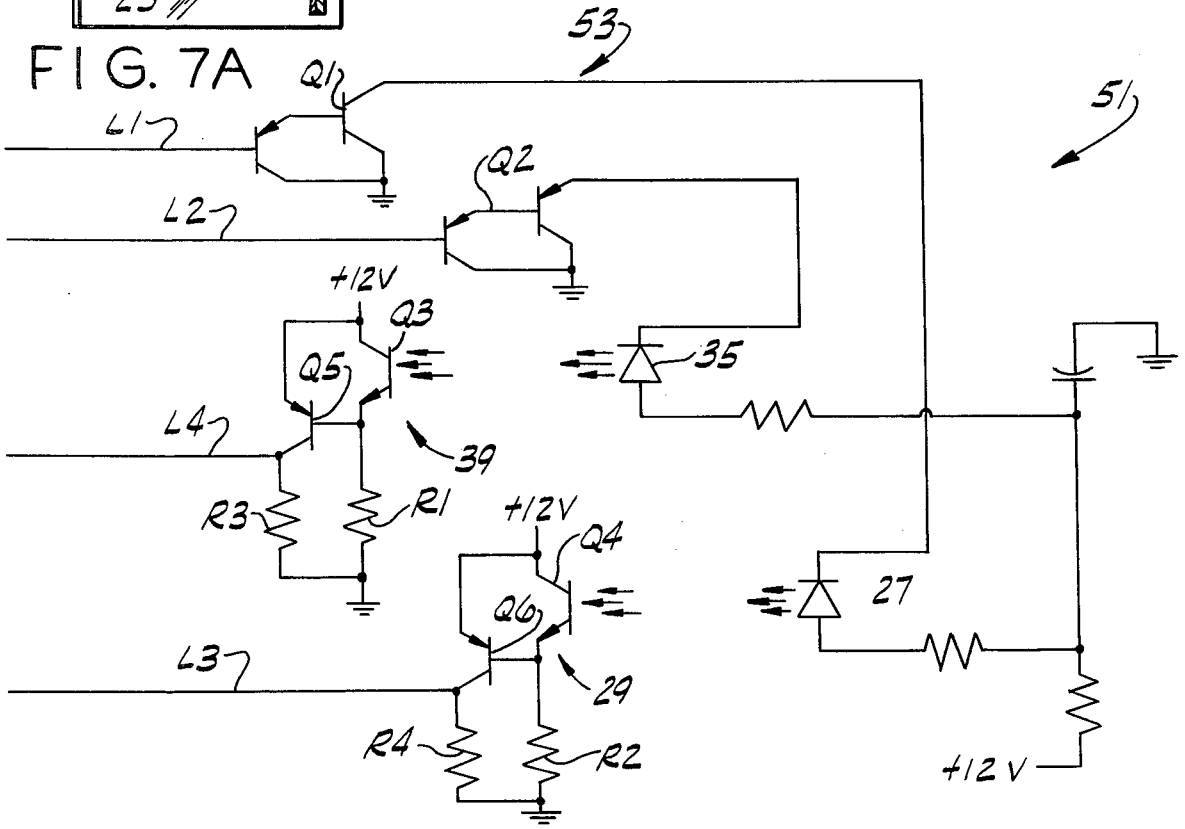
FIGS. 7A and 7B together constitute a diagram of the electrical circuitry of the present invention.
Figure 7B:
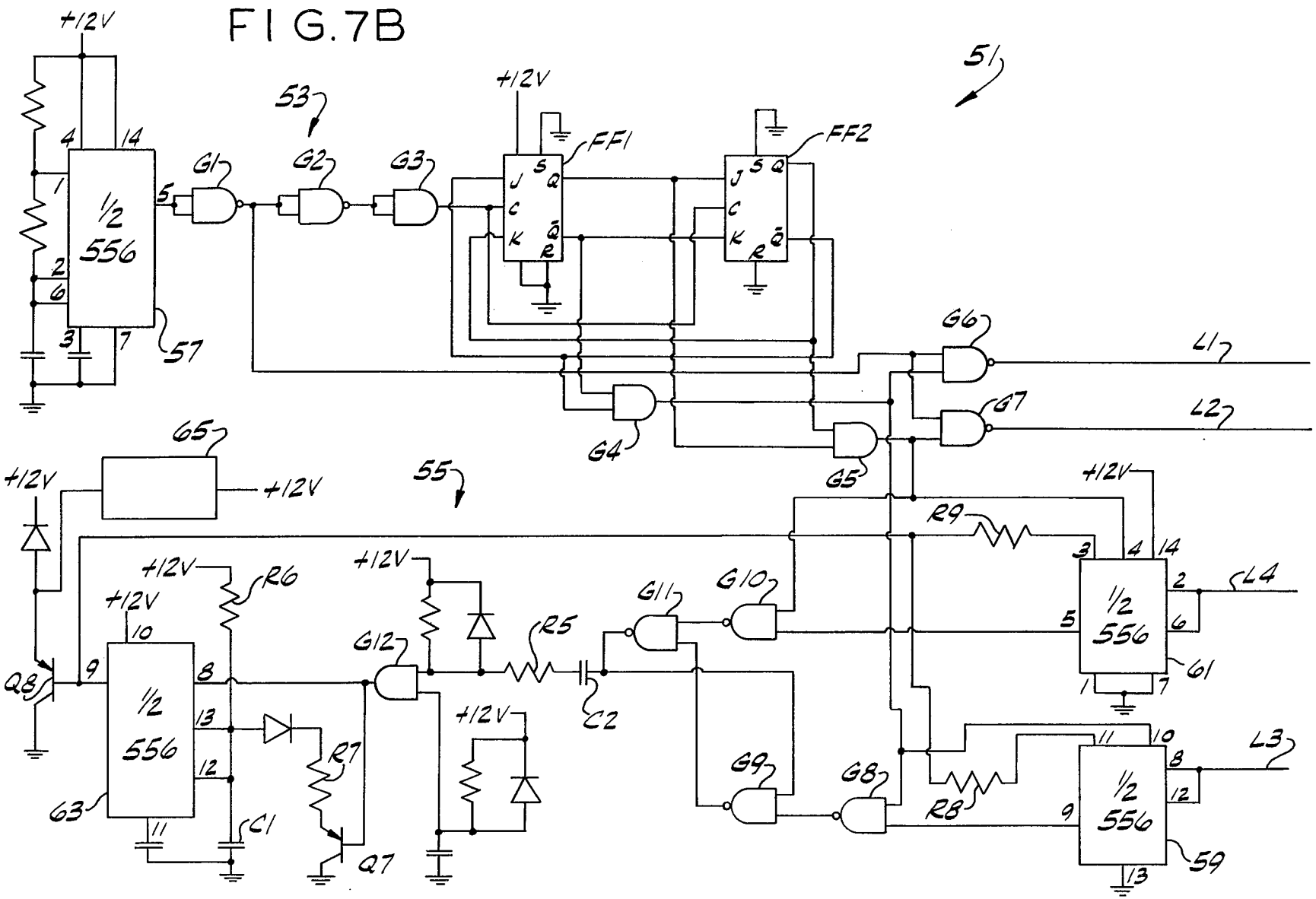

As is shown in FIG. 7A, emitters 27 and 35 are light-emitting diodes, each diode being connected between a +12 V source and energizing circuit 53. Specifically, light-emitting diode 27 is connected between a +12 V source and the emitter of a PNP Darlington pair Q1. Light-emitting diode 35 is connected between the +12 V source and the emitter of a PNP Darlington pair Q2. When the Darlington pairs conduct, they provide a path to ground for their respective diodes, thereby energizing them.

The bases of Darlington pairs Q1 and Q2 are connected by two lines, indicated respectively by the reference numerals L1 and L2, to the rest of energizing circuit 53. Briefly, the rest of circuit 53 comprises a timer 57 (which consists of one-half of a 556-type integrated circuit), seven gates G1-G7, of which gates G1, G2, G6 and G7 are NAND gates and gates G3, G4 and G5 are AND gates; and two J-K flip-flops FF1 and FF2 (which are incorporated on one Motorola 14027-type integrated circuit).

Timer 57 is connected as shown for astable operation, its output being Low for about 0.188 ms, then High for about 7.07 ms and so on. Thus, the output of timer 57 can be thought of as a series of pulses having a duration of 0.188 ms and a frequency of approximately 140 Hz. These pulses are inverted by gate G1 and supplied therefrom to gates G2, G6 and G7. Gate G2 reinverts the pulses and supplies them through gate G3 to the clock inputs of flip-flops FF1 and FF2.

Because of the way flip-flops FF1 and FF2 are interconnected, only the outputs of one flip-flop will change per each clocking pulse. For example, if the first clocking pulse changes the Q and $\overline{Q}$ output of flip-flop FF1, the second clocking pulse will change the Q and $\overline{Q}$ outputs of flip-flop FF2 but not those of flip-flop FF1, the third clocking pulse will change the Q and $\overline{Q}$ outputs of flip-flop FF1 but not that of flip-flop FF2 and so on.

The Q outputs of the flip-flops are connected to gate G5 and the $\overline{Q}$ outputs are connected to gate G4. Both Q outputs are High after every fourth clocking pulse until the following clocking pulse. Thus, the output of gate G5 is normally Low but goes High for approximately 7.25 ms every 29.03 ms. Likewise, both Q outputs are High two clocking pulses after the Q outputs are High. Thus, the output of gate G4 is normally Low but goes High for approximately 7.25 ms every 29.03 ms. Of course, since the Q and $\overline{Q}$ outputs by definition are never High at the same time, neither are the outputs of gates G4 and G5 High at the same time, i.e., their outputs are out of phase. These out of phase High outputs of gates G4 and G5 are supplied to gates G6 and G7 respectively. As noted above, High pulses from gate G1 are supplied to the other input of each of these gates. When both inputs of gate G6 are High, its output goes Low. This output remains Low only for the duration of the clock or triggering pulse. Likewise, when both inputs to gate G7 are High, which happens after every fourth clock or triggering pulse, its output goes Low for approximately 0.188 ms. Since gates G6 and G7 receive out of phase High outputs from gates G4 and G5, their Low outputs are also out of phase. When the output of gate G6 is Low, that of gate G7 is High; and when the output of gate G7 is Low, that of gate G6 is High. The converse is not true, however; the outputs of gates G6 and G7 are often High at the same time. Thus, the outputs of gates G6 and G7 are both series of Low pulses, but these series are completely out of phase with one another.

These series of Low pulses from gates G6 and G7 are supplied via lines L1 and L2 to the base of Darlington pairs Q1 and Q2. When the base of one of the pairs goes Low, it completes a path to ground for its respective light-emitting diode causing it to emit infrared radiation across the delivery station. Thus, the diodes each emit a series of pulses of radiation, each pulse having a duration of about 0.188 ms, the frequency of the pulses from each diode being generally one-fourth of the frequency of the clock pulses from timer 57. Since pairs Q1 and Q2 conduct alternately, as a result of the Lows supplied to their bases being out of phase, diodes 27 and 35 emit radiation across the delivery station alternately. Thus, when one emitter is emitting electromagnetic radiation the other is disabled from emitting radiation. Timer 57, therefore, in general constitutes means for supplying triggering pulses to emitters 27 and 35, i.e., it supplies pulses which cause said emitters to emit radiation. And flip-flops FF1 and FF2 together with gates G4-G7 constitute means for supplying those triggering pulses to the emitters alternatively.

Assuming for the moment that no article is present at the delivery station, the pulses of radiation from each emitter cross the delivery station and fall upon their respective detectors. Each detector consists of NPN phototransistor (Q3 and Q4), a PNP transistor (Q5 and Q6), a first resistor (R1 and R2) and a second resistor (R3 and R4). The collector of each phototransistor is connected to a +12 V source and to the emitter of its respective PNP transistor. The emitter of each phototransistor is connected to the base of its respective PNP transistor and through its respective first resistor to ground. The collector of each PNP transistor of the detectors is connected through its respective second resistor to ground. The output of each detector is taken at the collector of its PNP transistor. When electromagnetic radiation falls on the base of the phototransistor of a detector, its output goes Low; otherwise its output is High. Since the output of each of emitters 27 and 35 is a series of pulses of radiation, the output of each of their corresponding detectors when no article is present at the delivery station is a series of pulses substantially in phase with the triggering pulses supplied to its respective emitter.

The pulse voltage of the pulses from each of the detectors is determined by the amount of radiation falling of the base of that detector's phototransistor as well as by the value of resistor R3 in the case of detector 39 and the value of resistor R4 in the case of detector 29. Using detector 29 as an example, when no article is obstructing the beam between emitter 27 and detector 29 the pulse voltage is a maximum, i.e., the voltage measured at the collector of transistor Q6 while emitter 27 is radiating reaches its lowest value. As an article obstructs more and more of the beam, the voltage at the collector of transistor Q6 during the pulse becomes higher and hence the pulse voltage (which is the difference between the voltage at the collector when the base of the detector is irradiated and the voltage when it is not) decreases.

It will be appreciated that when the article completely blocks the beam between an emitter and its corresponding detector the pulse voltage is zero.

The output of each detector is supplied to the trigger and threshold inputs of a timer, the output of detector 29 being supplied to a timer 59 via a line L3 and the output of detector 39 being supplied to a timer 61 via a line L4. (Timers 59 and 61 are each one-half of a 556-type timer integrated circuit). When the output of a detector falls below the trigger voltage, which is typically 4 V, the timer is triggered and that timer's output goes High until the output of its respective detector reaches the threshold voltage, which is typically 8 V. The output of each detector is above the threshold voltage when no electromagnetic radiation is falling upon the base of its phototransistor and it is below the trigger voltage when a pulse of radiation which has not been obstructed falls upon said base. Accordingly, the output of each timer 59 and 61 goes High when an unobstructed pulse of radiation falls upon the base of its corresponding detector's phototransistor and the output of each goes (or stays) Low whenever insufficient radiation falls upon the base of its detector's phototransistor to cause that detector's output voltage to fall below the trigger voltage. This lack of radiation occurs both when the radiation is obstructed by an article at the delivery station and between pulses. Thus, the output of each timer 59 and 61 is a series of positive pulses of about 0.188 ms in duration at a frequency of about 35 Hz when no article is present at the delivery station. But when an article is present at the delivery station, the pulses from at least one of timers 59 and 61 ceases because of the obstruction of the beam to its respective detector. Another way to look at the situation when an article is present at the delivery station is that the pulse voltage from at least one of the detectors decreases to no more than a first predetermined voltage which corresponds to a lower output voltage of that detector greater than the trigger voltage of its respective timer. When such a pulse is supplied from a detector to its respective timer, the output of that timer stays Low.

Timers 59 and 61 are part of logic circuit 55. Circuit 55 also includes four NAND gates G8-G11, an AND gate G12, a timer 63 (which is one-half of a 556-type timer) a timing capacitor C1 and two PNP transistors Q7 and Q8. The outputs of timers 59 and 61 are supplied to gates G8 and G10 respectively. The other input to gate G8 is connected to the output of gate G4 and the other input to gate G10 is connected to the output of gate G5.

The outputs of gates G4 and G5 are also supplied to the reset pins of timers 59 and 61 respectively so that when the output of gate G4 is Low the output of timer 59 is Low and when the output of gate G5 is Low the output of timer 61 is Low. Since, as explained above, the output of gate G4 is always Low when emitter 35 is energized, and the output of gate G5 is always High at that time, logic circuit 55 is responsive only to detector 39 when emitter 35 is energized. Because the Low supplied from gate G4 to the reset pin of timer 59 forces the output of said timer to remain Low, logic circuit 55 is not responsive to detector 29 when emitter 35 is energized. Likewise, when emitter 27 is energized, the output of gate G4 is High and that of gate G5 is Low, so logic circuit 55 is responsive only to detector 29 when emitter 27 is energized. Even though detector 39 might be receiving radiation from emitter 27 when the latter is energized, logic circuit 55 will not be responsive to the resulting output of detector 39. Thus, timers 59 and 61 can supply pulses to the rest of logic circuit 55 only when their respective emitters are energized.

When a pulse of radiation from emitter 27 is detected by detector 29, the output of timer 59 is a positive pulse which is supplied to gate G8. Since the other input to gate G8, which is the output of gate G4, is High at this time, the output of gate G8 is a Low or negative pulse. This negative pulse is supplied to gate G9 causing its output to go High. Gates G9 and G11 are connected in a latch arrangement with the output of gate G11 being the output of the latch. The output of gate G9 is thus latched High and the output of gate G11 is latched Low.

This Low output is supplied via a 0.01 $\mu$F capacitor C2 and a 1.5K resistor R5 to gate G12, causing its output to go Low. This Low is supplied to the trigger input of timer 63 and to the base of PNP transistor Q7. The timing components of timer 63 are capacitor C1 and a resistor R6. Their values are chosen to cause the output of timer 63 to remain High for about 363 ms after each trigger pulse. Gate G12 supplies this trigger pulse to timer 63 but also at the same time discharges capacitor C1 through a 100 $\Omega$ resistor R7 and the PNP transistor Q7.

When a pulse of radiation from emitter 35 is detected by detector 39, the output of timer 61 is a positive pulse which is supplied to gate G10. At this time the other input of gate G10 is also High, so its output is a Low pulse which is supplied to gate G11 to reset the latch consisting of gates G9 and G11. The output of gate G11 thereupon goes High.

The next pulse of radiation, since emitters 27 and 35 are energized alternately, is from emitter 27. If it is unobstructed, the output of timer 59 is again a positive pulse which, as explained above, causes the output of gate G11 to go Low, which in turn causes gate G12 to trigger timer 63 and discharge capacitor C1. Because the output of gate G11 goes Low more often than every 363 ms so long as both detectors are receiving pulses from their respective emitters, the output of timer 63 will not go Low so long as neither detector detects an articls at the delivery station.

When detector 29 detects an article between it and its respective emitter, its output decreases to the point where the pulse voltage of its pulses is less than the first predetermined voltage or even zero. As explained above, timer 59 is not triggered by these pulses, so its output remains Low instead of being a series of positive pulses as it was when no article was present at the delivery station. Since timer 59 is no longer generating pulses, the latch consisting of gates G9 and G11 is no longer set as before. The output of gate G11 remains High. Even though timer 61 may still be supplying positive pulses to gate G10 to reset the latch, the set pulses is no longer supplied to it. As a consequence capacitor C1 is not periodically discharged and timer 63 times out, causing its output to go Low. This Low output of timer 63 is supplied to the base of PNP transistor Q8 causing it to conduct. The collector of transistor Q8 is connected to ground, so when timer 63 times out the emitter of transistor Q8 is provided a path to ground. The emitter of transistor Q8 is connected to a solenoid or relay 65 which is energized when said transistor conducts. Energization of this solenoid or relay causes the door in front of the delivery station to open to permit access to the article. Of course, the energization of solenoid or relay 65 is also used to perform various other functions which must be performed when the article is present at the delivery station.

Similarly, when detector 39 detects the presence of an article at the delivery station, timer 61 is not triggered and its output remains Low. In this situation, the latch consisting of gates G9 and G11 is set if detector 29 does not detect the article, but it cannot be reset. The output of gate G11 therefore, stays Low. Because of the presence of capacitor C2 the input to gate G12 goes High and stays High and timer 63 times out, causing its output to go Low as before.

When both detectors detect the article, the result is the same. The output of gate G11 does not change and timer 63 times out. Thus, timer 63 constitutes means for detecting when pulses from at least one of the detectors have a pulse voltage no greater than the first predetermined voltage and, when such pulses are detected, for generating an output signal, i.e., the Low output of timer 63, indicating that an article is present at the delivery station.

This Low output of timer 63 is also supplied via two lK resistors R8 and R9 to the control inputs of timers 59 and 61. This causes the trigger voltage of each timer to decrease to about IV, thereby causing the pulse voltage needed to trigger said timers to increase substantially to a second predetermined pulse voltage. That is, the control inputs of timers 59 and 61 constitute threshold changing means for receiving the output signal of timer 63 and, when that signal is received, for changing the maximum pulse voltage indicative of the presence of an article at the delivery station from the first predetermined pulse voltage to a second predetermined pulse voltage. As a result of this changing of the triggering voltage, a very strong pulse, clearly indicating the absence of an article at the delivery station must be received by one of the timers before it will supply any positive pulses to the rest of logic circuit 55. This ensures that a relatively slight variation in the output of the detectors after an article has been detected at the delivery station will not cause logic circuit 55 to erroneously determine that the article is no longer present at the delivery station.

Figure 8:
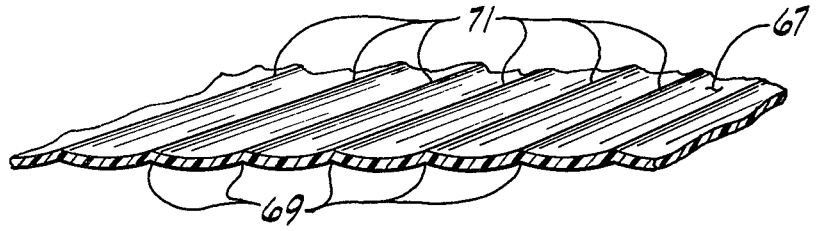
FIG. 8 is a sectional perspective of a segment of the tray of the elevator of the present invention.

It has been found that if the surface of elevator 23 on which the article to be vended is disposed after delivery to the delivery station is smooth, said surface being designated by the reference numeral 67 (see FIGS. 2, 3, 4 and 8), radiation from the emitters can reflect off surface 67 into their respective detectors even though an article blocks the straight-line path between each emitter and its detector. When this reflection is strong enough, the article present at the delivery station will not be detected. For example, the bottom of a carton of milk is not perfectly flat and sometimes, therefore, there is a gap between the bottom of such a carton and surface 67, albeit a small gap. This gap can allow enough radiation to reach the respective detector that the milk carton will not be detected. The present invention solves this problem by providing a series of parallel ridges 69 on surface 67 (see FIG. 8), disposed generally at right angles to the straightline paths between the emitters and their corresponding detectors. The crests of these ridges, indicated by the reference numeral 71, are spaced 1¼ inches (3.175 cm) apart. Ridges 69 with crests 71 deflect any radiation impinging upon surface 67 up and away from the detectors and thus insure that the detector does not operate erroneously because of radiation reflected off the surface. The ridges themselves are small, their height above the lowest point of surface 67 being on the order of 0.1 inches (0.254 cm). The crests on the other hand, are quite sharp, having a radius generally on the order of 0.03 inches (0.076 cm) or less. If the crests were not sharp, they themselves could reflect enough radiation to a detector to result in an article not being detected.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A multiple-beam optical sensing system for an article vendor having a delivery station to which an article to be vended is delivered during the vend, comprising:

first and second optoelectronic emitters for emitting electromagnetic radiation across the delivery station;

first and second optoelectronic detectors, each optoelectronic detector being disposed across the delivery station from its respective emitter for detecting electromagnetic radiation emitted by said emitter, the radiation from the first and second emitters being unobstructed in its passage across the delivery station from said emitters to their respective detectors when no article is present at the delivery station but being at least partially obstructed when an article is present at the delivery station, each detector being responsive to at least partial obstruction of the electromagnetic radiation from its respective emitter to detect the presence of an article at the delivery station;

means for energizing the first and second emitters alternately, each emitter being disabled when the other emitter is energized so that when one of said emitters is emitting electromagnetic radiation the other of said emitters is disabled, said energizing means including means for supplying triggering pulses to the first and second emitters alternately whereby the output of each emitter is a series of pulses of radiation and the output of each detector when no article is present at the delivery station is a series of voltage pulses, each of said pulses when no article is present at the delivery station being of at least a predetermined pulse voltage, the maximum pulse voltage of the pulses from at least one of the detectors being no more than a first predetermined pulse voltage when an article is present at the delivery station; and logic means controlled by the energizing means and responsive to the detectors for determining whether an article is present at the delivery station, said energizing means controlling the logic means to be responsive to a detector when its respective emitter is energized, whereby said logic means determines that an article has been delivered to the delivery station if at least one of said detectors detects an article at the delivery station while its respective emitter is energized; wherein the logic means includes output means for detecting when pulses from at least one of the detectors have a pulse voltage no greater than said first predetermined pulse voltage and, when such is detected, for generating an output signal indicating that an article is present at the delivery station; and wherein the logic means includes threshold changing means for receiving the output signal of the output means and, when said output signal is received, for changing the maximum pulse voltage indicative of the presence of an article at the delivery station from the first predetermined pulse voltage to a second predetermined pulse voltage, said second predetermined pulse voltage being greater than said first predetermined pulse voltage, thereby ensuring that a relatively slight variation in the output of the detectors after an article has been detected at the delivery station will not cause the logic means to erroneously determine that the article is no longer present at the delivery station.

2. A multiple beam optical sensing system for an article vendor having a delivery station to which an article to be vended is delivered during the vend, comprising: first and second optoelectronic emitters for emitting electromagnetic radiation across the delivery station;

first and second optoelectronic detectors, each optoelectronic detector being disposed across the delivery station from its respective emitter for detecting electromagnetic radiation emitted by said emitter, the radiation from the first and second emitters being unobstructed in its passage across the delivery station from said emitters to their respective detectors when no article is present at the delivery station but being at least partially obstructed when an article is present at the delivery station, each detector being responsive to at least partial obstruction of the electromagnetic radiation from its respective emitter to detect the presence of an article at the delivery station;

means for energizing the first and second emitters alternately, each emitter being disabled when the other emitter is energized so that when one of said emitters is emitting electromagnetic radiation the other of said emitters is disabled;

logic means controlled by the energizing means and responsive to the detectors for determining whether an article is present at the delivery station, said energizing means controlling the logic means to be responsive to a detector when its respective emitter is energized, whereby said logic means determines that an article has been delivered to the delivery station if at least one of said detectors detects an article at the delivery station while its respective emitter is energized; and a surface at the delivery station on which an article to be vended is disposed after delivery to the delivery station, said emitters being disposed above and to the sides of said surface for emitting electromagnetic radiation across the surface, said detectors being disposed above the surface and across the surface from their respective emitters, said surface including at least one ridge for deflecting radiation which strikes the surface away from the corresponding detector, said ridge being generally disposed at an angle to the straight lines between the emitters and their respective detectors and having a substantially sharp crest, thereby ensuring that if an article at least partially obstructs the passage of radiation across the delivery station the detector will detect it and will not operate erroneously because of radiation reflected off the surface.

3. A multiple-beam optical sensing system as set forth in claim 2 wherein said surface includes a series of generally parallel ridges, each ridge having a substantially sharp crest and being disposed at an angle to the straight lines between the emitters and their respective detectors.

4. A multiple-beam optical sensing system as set forth in claim 3 wherein each ridge is disposed generally at right angles to the straight line between the emitter and the detector.

5. An article sensing system for an article vendor having a delivery station to which an article to be vended is delivered during the vend, comprising:

a surface at the delivery station on which an article to be vended is disposed after delivery to the delivery station;

an optoelectronic emitter disposed above and to one side of said surface for emitting electromagnetic radiation across the surface; and an optoelectronic detector disposed above said surface and across said surface from the emitter for detecting electromagnetic radiation emitted by said emitter, the radiation from the emitter being unobstructed in its passage across the surface from the emitter to the detector when no article is present at the delivery station but being at least partially obstructed when an article is present at the delivery station, the detector being responsive to at least partial obstruction of the electromagnetic radiation from the emitter to detect the presence of an article at the delivery station;

said surface including at least one ridge for deflecting radiation which strikes the surface away from the detector, said ridge being generally disposed at an angle to the straight line between the emitter and the detector and having a substantially sharp crest, thereby ensuring that if an article at least partially obstructs the passage of radiation across the delivery station the detector will detect it and will not operate erroneously because of radiation reflected off the surface.

6. An article sensing system as set forth in claim 5 wherein said surface includes a series of generally parallel ridges, each ridge having a substantially sharp crest and being disposed at an angle to the straight line between the emitter and the detector.

7. An article sensing system as set forth in claim 6 wherein each ridge is disposed generally at right angles to the straight line between the emitter and the detector.

* * * * *